United States Patent [19]

Exline

[11] 4,094,217

[45] June 13, 1978

[54] SAFETY SLITTER FOR THERMOPLASTIC SHEET

[75] Inventor: Roger Edsel Exline, Parkersburg, W. Va.

[73] Assignee: Borg-Warner Corporation, Chicago, Ill.

[21] Appl. No.: 810,696

[22] Filed: Jun. 28, 1977

[51] Int. Cl.[2] ..... B26D 3/08

[52] U.S. Cl. ..... 83/6; 83/368; 83/433; 83/545; 83/563; 83/582; 83/856

[58] Field of Search ..... 83/6, 7, 11, 368, 433, 83/545, 563, 564, 582, 856, 858

[56] References Cited

U.S. PATENT DOCUMENTS

| | | | |
|---|---|---|---|
| 2,316,249 | 4/1913 | Johnson | 83/368 |
| 3,961,551 | 6/1976 | Doyle | 83/545 X |

*Primary Examiner*—J. M. Meister

*Attorney, Agent, or Firm*—William S. McCurry

[57] ABSTRACT

An automatically retractable slitter for cutting thermoplastic sheet as it exits from the sheet die of an extruder comprising a housing, a cutter blade mounted in a holder, a recess in the housing of a length greater than the length of the holder for slidably and retractably receiving the holder and blade, an elongated slot in said housing having detent means, an elongated pin secured to said holder and extending transversely through the elongated slot, spring means between the holder and the housing adapted to be relaxed when the holder is in its retractable position within the recess, the pin being adapted to rest in the detent when a cutting force is applied to the blade and to disengage from the detent when no force is applied to the blade.

1 Claim, 4 Drawing Figures

Fig.1.
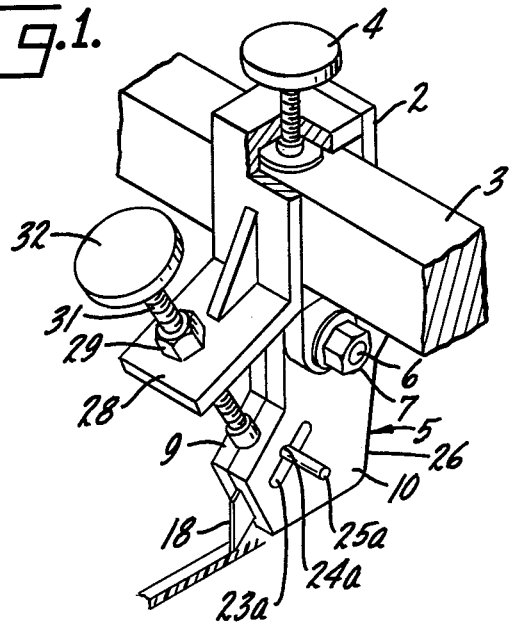
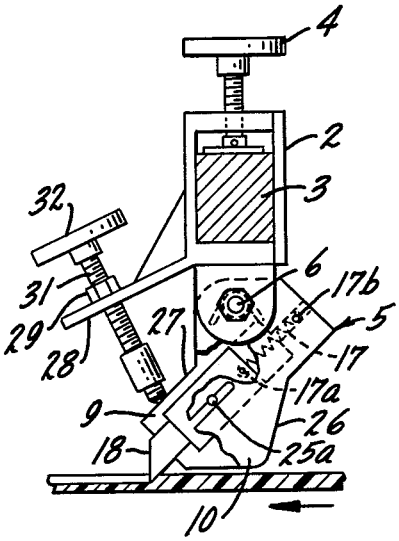
Fig.2.
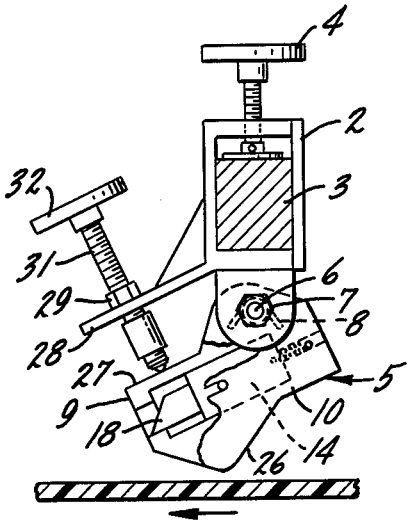
Fig.3.

SAFETY SLITTER FOR THERMOPLASTIC SHEET

BACKGROUND AND SUMMARY OF THE INVENTION

The present invention relates to an improved slitter blade for slitting thermoplastic sheet as it exits from a sheet extrusion die.

In the manufacture of thermoplastic sheet from such thermoplastic polymers as graft ABS, polyethylene, polyvinyl chloride, polystyrene, polycarbonates and the like, a single sheet delivered by an extrusion die is often times slit or cut into a plurality of sheets. A plurality of blades are mounted on a bar which extends across the entire width of the sheet. The bar is rotated to positions and locked for the engagement and disengagement of the blades of the slitter with the sheet.

The blades are securely fastened to a blade holder and are a hazard to the operators of the sheet extrusion equipment, especially when the bar is rotated to position the blades away from their cutting position.

The object of the present invention is to provide a cutter blade which is exposed only when the blade is in the sheet cutting position and at all other times be automatically retracted into a blade housing. The blade of the present invention will automatically retract to a safe, shielded position when the blade is moved laterally for different width cuts; whenever the sheet breaks; whenever the extruder accidentally runs out of material and no sheet is moving on the line; and when production is completed and the extrusion line is shut down. The present blade retractor eliminates the hazard of an exposed blade before the operator can come in contact therewith and the retractable feature is not dependent on any action by the operator.

THE DRAWINGS

FIG. 1 is a perspective view of the slitting apparatus of the present invention mounted on a rotatable bar;

FIG. 2 is a plan view, partly in section, showing the slitter blade extended and in cutting position;

FIG. 3 is a plan view, partly in section, showing the slitter blade retracted; and FIG. 4 is an enlarged, exploded view showing a part of the retractable feature of the present invention.

DESCRIPTION OF THE DRAWINGS

Referring to FIG. 1 of the drawings, the present safety slitter comprises a blade holder support 2 slidably mounted on a rotating bar 3 and adapted to be secured thereto from lateral movement by means of an adjusting screw 4 (the means for rotating the bar forms no part of the present invention and is not disclosed). Mounted for pivotal movement on the blade holder support 2 is a blade housing 5. The blade housing 5 is attached to the support 2 by means of a pin 6 and nut 7. A spring 8 (FIG. 3) is provided between the support 2 and the blade housing 5 to urge the blade housing 5 into a position away from the sheets.

Figure 4:
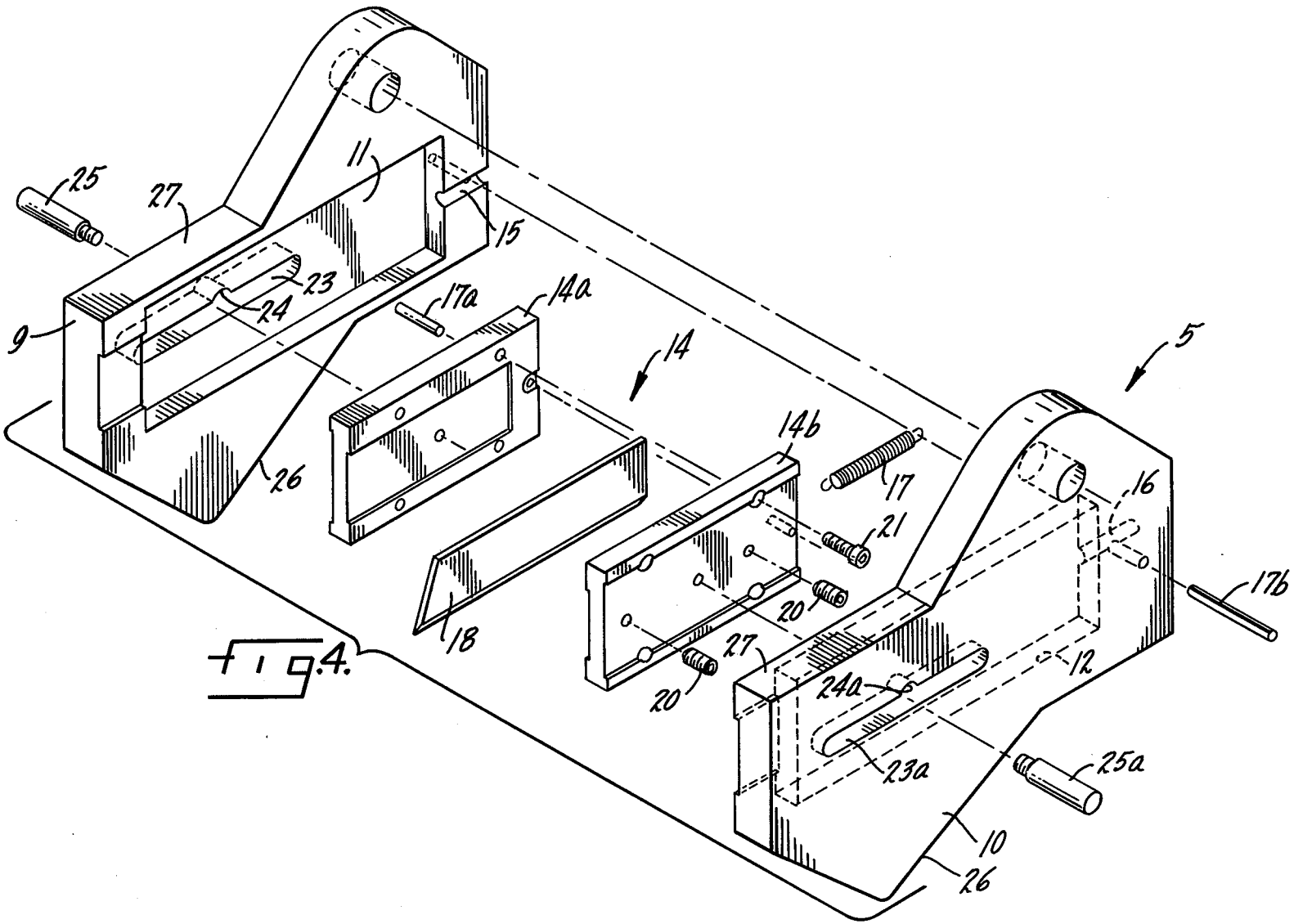
Referring to FIG. 4, the blade housing 5 is made of two separate substantially identical halves 9 and 10. Each half 9, 10 has a recess 11, 12 for receiving a slidable blade holder 14 made of separate halves **14*a* and 14*b*. Also provided in each half are semi-circular recesses 15, 16 for housing a blade holder retracting spring 17. A blade 18 is secured in the blade holder 14 by means of Allen-head screws 20. The spring 17, one end of which is attached to a pin 17*a* in the holder 14 and the other end attached to a pin 17*b* in the blade housing 5, is in tension when the blade 18 and its holder 14 are in their extended, operative position and relaxed when the blade is retracted. The screws 20 permit easy replacement of the blade 18. A plurality of Allen-head screws 21, only one of which is shown, secure the two halves 14*a*, 14*b* of the holder 14** together.

Each half of the blade housing 5 is also provided with an elongated slot 23, **23*a* respectively, each slot having a shallow detent recess 24, 24*a* respectively. A pin 25 is mounted in the blade holder half 14*a* and extends through the elongated slot 23 and substantially beyond the housing 5. Likewise, a pin 25*a* is mounted in the blade holder half 14*b*. The housing 5 further has a surface 26 providing a safety guard for the hand and fingers of the operator and a straight surface 27** on the other side of the housing.

The blade support holder 2, FIGS. 1 and 2, has a flange 28 depending therefrom and containing an adjusting nut 29. An adjusting screw 31, adapted to be actuated by an adjusting knob 32, is threadedly engaged with the nut 29. The adjusting screw 31 is provided to position the blade housing 5 in a blade cutting relationship with the thermoplastic sheets.

OPERATION

In operation, the adjusting knob 32 is rotated counterclockwise to permit the blade housing 5 to swing outwardly and upwardly far enough for the blade 18 to be extended outward to a point where the elongated pins 25, **25*a* can be engaged in the detents 24, 24*a* of the elongated slots 23, 23*a*. The pins 25, 25*a* are grasped by the operator and placed into the detents 24, 24*a* and then the adjusting knob 32 is turned clockwise until the blade 18 swings into a cutting position on the sheet as seen in FIG. 2. At this point the forward pressure imposed on the blade 18 by the moving sheets will cause the pins 25, 25*a* to remain engaged in the detents 24, 24*a* and the blade 18 will remain in its extended, cutting position so long as pressure is exerted by the moving sheets on the blade 18. In the event no sheet is present due to lack of material or sheet breakage, there will be no pressure on the blade to hold the pins 25, 25*a* in the detents. The pins 25, 25*a* will thus move out of the detents and the retracting spring 17 will pull the blade holder 14 into its retracted position as seen in FIG. 3**.

While this invention has been described in connection with a certain embodiment thereof, it is to be understood that this is by way of illustration and not by way of limitation; and the scope of this invention is defined solely by the appended claim which should be construed as broadly as the prior art will permit.

I claim:

1. An improved, automatically retractable safety slitter for cutting thermoplastic sheet as it exits from the sheet die of an extruder comprising a housing, a cutter blade mounted in a holder, a recess in said housing of a length greater than the length of said holder for slidably and retractably receiving said holder, an elongated slot in said housing having detent means, an elongated pin secured to said holder and extending transversely through said elongated slot, tension spring means between said holder and said housing adapted to be relaxed when said holder is in its retractable position within said recess, said pin being adapted to rest in said detent when a cutting force is applied to said blade and to disengage from said detent when no force is applied to said blade.

* * * * *

Dedication 4,094,217.—*Roger Edsel Exline,* Parkersburg, W. Va. SAFETY SLITTER FOR THERMOPLASTIC SHEET. Patent dated June 13, 1978. Dedication filed Dec. 17, 1981, by the assignee, *Borg-Warner Chemicals, Inc.*

Hereby dedicates to the Public the remaining term of said patent.

[*Official Gazette March 2, 1982.*]